US008870313B2

(12) United States Patent
Grabherr et al.

(10) Patent No.: US 8,870,313 B2
(45) Date of Patent: Oct. 28, 2014

(54) PULL-OUT GUIDE FOR A DRAWER

(71) Applicant: Julius Blum GmbH, Hochst (AT)

(72) Inventors: Benjamin Grabherr, Hochst (AT); Marc Meusburger, Egg (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 14/072,041

(22) Filed: Nov. 5, 2013

(65) Prior Publication Data

US 2014/0055021 A1 Feb. 27, 2014

Related U.S. Application Data

(63) Continuation of application No. PCT/AT2012/000123, filed on May 2, 2012.

(30) Foreign Application Priority Data

May 5, 2011 (AT) ..... 628/2011

(51) Int. Cl.
*A47B 88/00* (2006.01)
*A47B 88/04* (2006.01)

(52) U.S. Cl.
CPC ..... *A47B 88/0422* (2013.01)
USPC ..... 312/334.5

(58) Field of Classification Search
USPC ..... 312/334.4, 334.5, 334.1, 334.8, 334.14, 312/334.32, 334.27, 330.1; 384/22
See application file for complete search history.

(56) References Cited

U.S. PATENT DOCUMENTS

| | | | | |
|---|---|---|---|---|
| 4,961,648 | A * | 10/1990 | Rock | 384/19 |
| 5,632,541 | A * | 5/1997 | Uthoff | 312/333 |
| 7,695,080 | B2 * | 4/2010 | Chen et al. | 312/333 |
| 7,980,642 | B2 * | 7/2011 | Lam et al. | 312/334.5 |
| 8,056,994 | B2 * | 11/2011 | Chen et al. | 312/334.6 |
| 8,220,884 | B2 * | 7/2012 | Berger | 312/334.4 |

(Continued)

FOREIGN PATENT DOCUMENTS

| | | |
|---|---|---|
| AT | 509 416 | 8/2011 |
| DE | 200 01 491 | 3/2000 |

(Continued)

OTHER PUBLICATIONS

International Search Report (ISR) issued Sep. 5, 2012 in International (PCT) Application No. PCT/AT2012/000123.

(Continued)

*Primary Examiner* — Janet M Wilkens
(74) *Attorney, Agent, or Firm* — Wenderoth, Lind & Ponack, L.L.P.

(57) ABSTRACT

A pull-out guide for a drawer has a body rail which can be attached to the furniture body and has at least one pull-out rail which can be moved relative to the body rail. The pull-out guide includes a holding element with at least one attachment member by which the holding element can be attached or is attached to the pull-out rail, and a connection element by which the drawer can be connected to the pull-out rail. The connection element is mounted such that it can be moved relative to the holding element between a first end position and a second end position. A spring element is provided, and the spring element holding the connection element in a neutral position located between the first end position and the second end position.

23 Claims, 11 Drawing Sheets

(56) References Cited

U.S. PATENT DOCUMENTS

| | | | | |
|---|---|---|---|---|
| 8,585,165 | B2 * | 11/2013 | Liang et al. | 312/334.4 |
| 2001/0019235 | A1 * | 9/2001 | Hammerle | 312/334.4 |
| 2004/0095047 | A1 * | 5/2004 | Salice | 312/332.1 |
| 2007/0262684 | A1 * | 11/2007 | Huang | 312/334.4 |
| 2009/0167128 | A1 * | 7/2009 | Berger | 312/334.4 |
| 2009/0212679 | A1 | 8/2009 | Frousiakis et al. | |
| 2009/0251037 | A1 * | 10/2009 | Berger | 312/334.1 |
| 2012/0080988 | A1 | 4/2012 | Greussing | |
| 2012/0292465 | A1 * | 11/2012 | Holzer et al. | 248/201 |
| 2012/0319548 | A1 * | 12/2012 | Netzer | 312/334.1 |

FOREIGN PATENT DOCUMENTS

| | | |
|---|---|---|
| DE | 299 23 509 | 11/2000 |
| DE | 203 21 444 | 6/2007 |
| WO | 2010/141964 | 12/2010 |

OTHER PUBLICATIONS

Austrian Patent Office Search Report (ASR) issued Jan. 30, 2012 in Austrian Patent Application No. A 628/2011.

* cited by examiner

PULL-OUT GUIDE FOR A DRAWER

BACKGROUND OF THE INVENTION

The invention relates to a pull-out guide for a drawer having a body rail, which is to be attached to a furniture body, and having at least one pull-out rail, which can be moved relative to the body rail. The guide includes a holding element with at least one attachment means, by which the holding element can be attached or is attached to the pull-out rail. The guide also has a connection element, by which the drawer can be connected to the pull-out rail, and the connection element is mounted such that it can be moved relative to the holding element between a first end position and a second end position.

The Austrian patent application A 148/2010 discloses a pull-out guide for a drawer, in which the pull-out guide, which can be moved relative to the body rail, comprises a holding element with a connection element, with which the drawer can be connected to the pull-out rail in an adjustable manner. An adjustment mechanism serves to move the connection element horizontally relative to the holding element, wherein a rotatory movement is converted into a translatory movement of the connection element by means of a rotationally movable converting mechanism. The drawer can thereby be moved in the lateral direction relative to the pull-out rail, in order, for example, to make the joint arrangement uniform or to establish a correct pull-out direction of the drawer in the furniture body.

In the case of a pull-out guide fitting according to the Austrian patent application A 148/2010, comprising two pull-out guides which are respectively arranged on two side panels of a drawer, provision is made for a holding element, as described above, having an adjustment mechanism for laterally aligning the drawer relative to the pull-out rail, to be arranged on a pull-out guide. However, on the side opposite this pull-out guide, it can be sufficient for the connection element to be mounted such that it can be moved relative to the holding element without providing its own adjustment mechanism for lateral adjustment. Hence, while the connection element on a pull-out guide is actively moved relative to the holding element using the adjustment mechanism, the connection element on the opposite side can passively follow these movements.

In addition to the lateral adjustment mechanism, which is only provided on one side, the holding elements can comprise further adjustment mechanisms on both pull-out guides for adjusting the height of the drawer relative to the pull-out rail, wherein the adjustment mechanism for height adjustment in each case can be actuated independently of the adjustment mechanism for lateral adjustment.

The disadvantage of such pull-out guides is that when the drawer is removed from the connection elements, these connection elements remain in the respectively withdrawn position. While resetting the connection element at that pull-out guide whose holding element is provided with an adjustment mechanism for lateral adjustment is still relatively easily possible, for the opposite connection element the associated connection point of the drawer, for example in the form of a recess, has first laboriously to be found, in order to place the corresponding connection element there. As a result, connecting or attaching the drawer to the pull-out guides again is made more difficult.

SUMMARY OF THE INVENTION

The object of the present invention is to avoid these disadvantages and provide a pull-out guide, in which the drawer can be refitted or reconnected to the pull-out guide more easily.

The pull-out guide according to the invention comprises a holding element which can be attached or is attached to the pull-out guide by at least one attachment means. The attachment means can also be an integral part of the pull-out (rail (i.e., the pull-out rail is formed as one piece with the integrally formed attachment means of the holding element).

The holding element furthermore comprises a connection element, by which the drawer can be connected or is connected to the pull-out rail. The connection element is connected to the drawer itself. The connection to the pull-out rail is ultimately made via the holding element. The connection element is mounted such that it can be moved, preferably linearly slid, relative to the holding element between a first end position and a second end position. When the drawer is connected to the connection element, a relative movement between the drawer and the pull-out rail is enabled by the relative movability of the connection element with respect to the holding element.

By now providing a spring element, by which the connection element is held in a neutral position which is located between the first end position and the second end position when it is not connected to the drawer, when the drawer is detached from the pull-out guide, the connection element is automatically reset to the neutral position. The neutral position can, for example, be arranged centrally between the first and the second end positions and hence correspond to a central position. The spring element produces a restoring force as soon as the connection element is displaced from the neutral position. The spring element is dimensioned in such a way that the connection element is reset when it is not connected to the drawer. The spring element thus has a restoring spring force such that it is too weak to move the connection element together with the connected drawer to the neutral position independently. This measure prevents the lateral adjustment by the adjustment mechanism mentioned in the introduction being counteracted, since the spring element essentially only takes effect in the state where there is no connection to the drawer. The spring element itself can have one or more elastically formed or spring-loaded parts. Provision can also be made to arrange one or more spring elements in the holding element according to the invention.

The connection element can, for example, be arranged in the drawer rear panel or in the drawer side panel, for example in the face side of the inner body of the same, for connection to the drawer. The pull-out guide according to the invention in particular enables a drawer consisting of a wood-based material to be assembled and adjusted, which as a general structural part can be detached from, can be attached to, preferably can be assembled without the use of tools on and/or can be disassembled without the use of tools from the pull-out guide.

Preferably, the holding element is connected to the drawer in the rear area, for example, connected to the drawer on the drawer rear panel. For this purpose, the holding element can be arranged on the rearward end of the pull-out guide or of the extensible rail of a pull-out guide.

In one embodiment of the invention, the pull-out guide comprises a middle rail arranged between the pull-out rail and the body rail and movable relative to them. Such a pull-out guide enables the drawer to be fully pulled out.

In one particularly preferred embodiment, the connection element is mounted such that it can be moved horizontally relative to the holding element in the assembled position of the pull-out guide, i.e. in the functional state. The movement of the connection element between the first and the second end positions is in this case horizontal. In particular, movability is provided in the lateral direction transverse to the longitudinal direction of the pull-out rail (i.e., the movement of the connection element between the first and the second end positions is lateral in the assembled position of the pull-out guide, that is to say, horizontal and perpendicular to the longitudinal direction of the pull-out rail).

The connection element can thereby be reset to a neutral position with respect to the lateral displacement of the connection element relative to the pull-out rail. In interaction with a holding element arranged on the opposite pull-out guide having an adjustment mechanism for lateral adjustment for actively moving the connection element, the holding element of the pull-out guide according to the invention can serve as a passive holding element with a movably mounted connection element. In the state connected to the drawer, the movement of the connection elements corresponds to one another, while in the unconnected state the connection element of the pull-out guide according to the invention is held in a neutral position.

Preferably, a guide device is arranged on the holding element, by which the connection element is guided such that it can be slid on the holding element.

This guide device can have a guide rail or guide ridge mounted in the holding element. A guide casing or guide profile, which at least partly encompasses the guide rail or the guide ridge and is mounted such that it can be slid along the guide rail, is arranged on the connection element. In principle, the profile of the guide rail or of the guide ridge can be any shape. The guide rail is simply formed as a guide pin. Such a guide device ensures that the connection element is correctly and stably slid in the lateral direction.

The guide device can furthermore have an elongated hole arranged in the holding element or a slotted guide arranged in the holding element, with which a guide pin or guide peg of the connection element engages. The guide pin or the guide peg is mounted such that it can be slid in the elongated hole or in the slot.

In a further embodiment of the invention, the connection element comprises a hook-shaped holding lug which, in the assembled state (in which the holding element is connected to the drawer), engages with recesses in the drawer. The recesses can be pre-drilled drill holes. The holding lug in the assembled state can be held within the recesses by a press fit or by a push fit. The holding lug can be cylindrical or can have additional latching elements for a more stable connection.

The connection element can be acted upon by the spring element or for the spring element itself to be part of the connection element, and hence can be elastically formed. However, in the case of a hook-shaped holding lug, the holding lug can be elastically formed or be acted upon by a spring element. The spring strength is to be selected corresponding to the above criteria.

In one embodiment, a height-adjustment mechanism is provided for vertically moving the connection element on the holding element, by which the vertical position of the drawer relative to the pull-out guide (i.e., with regard to its "height"), can be set. The movement of the connection element is transferred to the drawer through the indirect or direct connection of the connection element to the drawer. The height adjustment comprises an adjustment mechanism, with which the extent of the vertical movement can be set and hence the drawer can be actively and finely adjusted relative to the pull-out rail. "Vertical" again refers to the assembled position of the pull-out guide.

A rotationally movable converting mechanism can at the same time be provided, wherein a rotatory movement of the converting mechanism can be converted into a translatory movement of the connection element. Preferably, the converting mechanism can be rotated or pivoted about an axis arranged essentially parallel to the longitudinal axis of the pull-out rail. By rotating or pivoting the converting mechanism, a transformation into a translatory movement of the connection element takes place using suitable mechanical means which are known in the prior art.

The converting mechanism can be pivotably or rotatably mounted on the holding part or on an attachment part which is mounted on the drawer. A vertical movement of the drawer relative to the pull-out rail always implicates a translatory movement. A converting mechanism, by which a rotatory movement component can be transformed into a translatory movement component, has the advantage that lever actions can be utilized, so that a delicate movement is actively possible. The height adjustment mechanism can thereby be designed in such a way that the vertical position of the drawer relative to the pull-out rail can be adjusted continuously or in stages.

In one embodiment, the converting mechanism is formed with a handle for actuating the height adjustment mechanism without the use of tools. The vertical position of the drawer relative to the pull-out rail can thereby be set easily.

However, additionally or alternatively, the converting mechanism can also be provided with a screw, wherein the converting mechanism can be actuated by a rotation of the screw.

In order to make height adjustment easier, the converting mechanism can be at least partly formed in the shape of a lever or eccentrically, so that manually only slight force is required to move even heavy and large drawers.

The converting mechanism can also comprise an adjusting wheel, which has a toothing, or an additional toothed wheel, which is engaged with a vertically arranged toothing, for example a toothed rack, to vertically move the drawer.

In one embodiment of the invention, the holding element is fixedly connected to the pull-out rail. For this purpose, stop faces or support elements can be integrally formed on the holding element which are engaged with corresponding recesses in the pull-out rail or are welded to the pull-out rails. However, the holding element can also be detachably connected to the pull-out rail.

To adjust the height, at least one support bracket can be arranged on the holding element, on which the drawer or the drawer bottom at least partly rests in the assembled state. The at least one support bracket can be vertically moved relative to the pull-out rail by the height adjustment mechanism and can be part of the connection element. The at least one support bracket can, however, also be arranged on the holding part, wherein the holding part is mounted such that it can be vertically moved on the holding element. Actuation of the height adjustment mechanism in this case produces the vertical movement of the holding part.

Furthermore, a further adjustment mechanism can also be provided, by which a movement of the connection element relative to the holding element in the assembled position takes place in the horizontal direction, preferably in the lateral direction with respect to the pull-out rail. This further adjustment mechanism in this case serves as a lateral adjustment mechanism. In principle, the lateral adjustment mechanism can be constructed similar to the height adjustment mechanism and can have similar mechanical means. Instead of a vertical translatory movement of the connection element, a horizontal translatory movement in the lateral direction (in each case in the assembled position of the pull-out guide) simply has to be generated.

The position of the drawer can be actively set with high accuracy both in the vertical and in the lateral directions by a height adjustment mechanism and a lateral adjustment mechanism. The lateral adjustment mechanism can be actuated independently of the height adjustment mechanism, whereby the lateral adjustment and the height adjustment are decoupled and the greatest possible variety of settings is provided.

The lateral adjustment mechanism and/or the height adjustment mechanism can be releasably locked by a locking device, so that further movement in the lateral direction and/or vertical direction of the drawer relative to the pull-out rail is prevented. Both the height adjustment mechanism and the lateral adjustment mechanism can be self-locking, so that after the drawer has been actively adjusted relative to the pull-out rail an automatic further movement in the lateral or vertical direction is prevented. This self-locking can, for example, be based on a frictional engagement of the components of the adjustment mechanism.

In the event that the lateral adjustment mechanism comprises a rotationally movable converting mechanism, which preferably can be rotated about an axis arranged essentially parallel to the longitudinal axis of the pull-out rail, a rotatory movement of the converting mechanism can be converted into a translatory movement of the connection element in the lateral direction (i.e., transverse to the pull-out rail).

The invention furthermore comprises a pull-out guide fitting for a drawer having two pull-out guides which are to be arranged on opposite sides of a drawer. The pull-out guide fitting comprises a pull-out guide as described above which is to be arranged on a first side of the drawer. A second pull-out guide, which is to be arranged on the opposite side of the drawer, comprises a second holding element having a second connection element. The second holding element is attached or can be attached to the second pull-out rail. The drawer can be connected to the pull-out rail of the second pull-out guide with the connection element.

According to the invention, the second holding element can have a lateral adjustment mechanism for setting the lateral position of the drawer relative to the pull-out rail of the second pull-out guide. The pull-out guide with the second holding element can be designed in the same manner as in the Austrian patent application A 148/2010. The lateral movement of the drawer relative to the pull-out rail is, according to this, effected by the second connection element. On the other hand, the connection element can be mounted essentially floating on the holding element of the pull-out guide opposite the second pull-out guide and due to the dimensioning of the spring element with respect to the spring strength can follow the relative movement of the second connection element on the second holding element of the second pull-out guide if a drawer is connected to both connection elements and via both holding elements to the pull-out rails of the first and second pull-out guides. The essentially floating mounting is preferably limited to being horizontally movable between the first and the second end positions of the connection element, while in the vertical direction an attachment or movability guided by a height adjustment device can be provided. However, in principle, a floating mounting of the connection element is also possible in both movement directions. The lateral adjustment mechanism of the second connection element is designed in such a way that the second connection element can be moved in a direction which corresponds to that between the first and the second end positions of the connection element or is parallel to it.

For laterally adjusting the drawer with the pull-out guide fitting according to the invention, a pull-out guide has an active lateral adjustment mechanism and the other pull-out guide has a passively guided connection element following the active adjustment, which is held by the spring element in a neutral position in a state not connected to the drawer, both pull-out guides can have a height adjustment mechanism which can be designed as described above. A height adjustment mechanism on both sides of the drawer prevents crooked fitting of the drawer with respect to the horizontal.

Both the height adjustment mechanisms and the lateral adjustment mechanism of both pull-out guides can be designed as described above.

The invention furthermore relates to a drawer having at least one pull-out guide as described above or a pull-out guide fitting as described above.

The invention furthermore relates to a piece of furniture having at least one such drawer.

BRIEF DESCRIPTION OF THE DRAWINGS

Further details and advantages of the present invention are explained more fully below by means of the description of the figures with reference to the drawings.

DETAILED DESCRIPTION OF THE INVENTION

Figure 1:
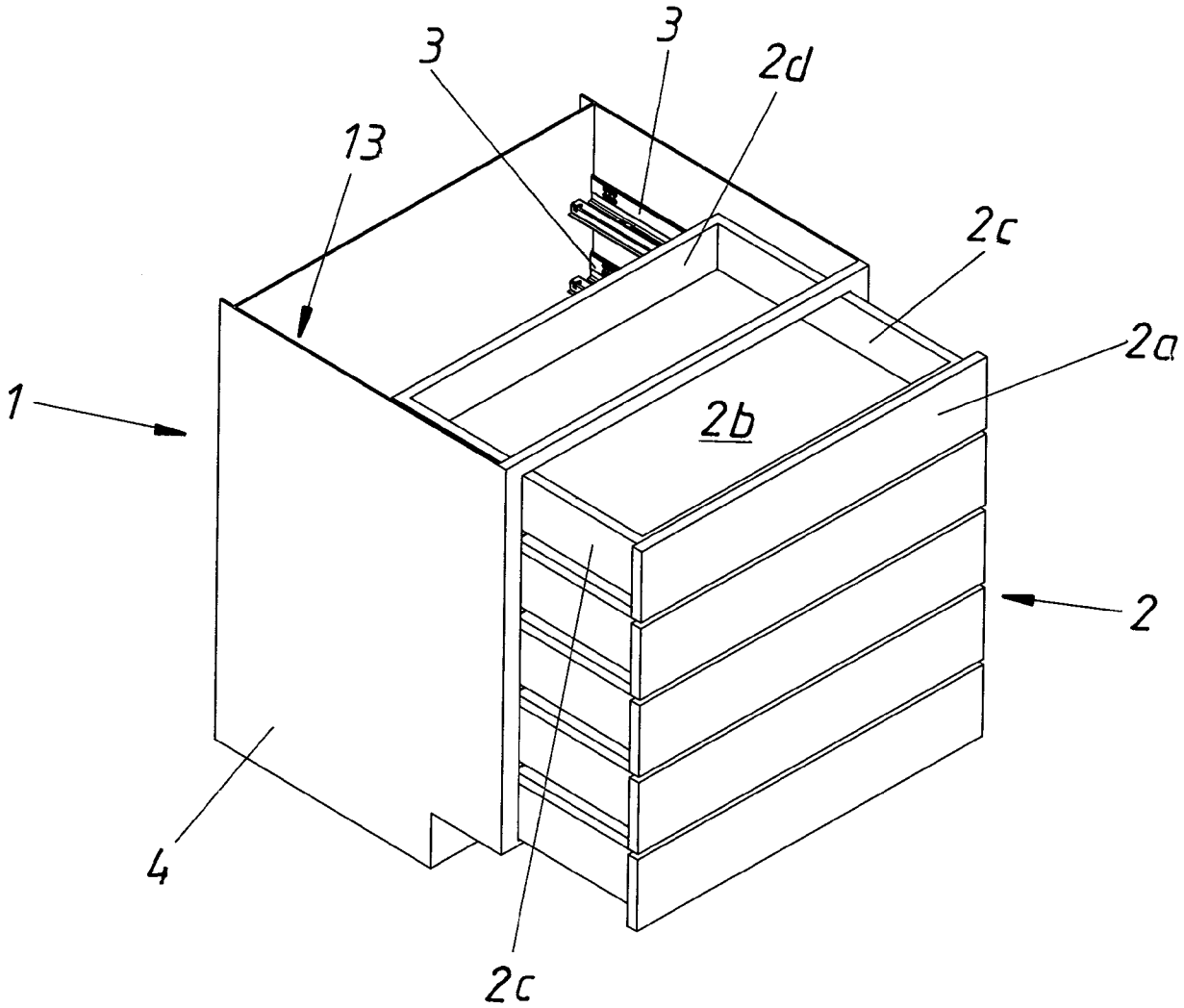
FIG. 1 shows a partly broken-open perspective view of a piece of furniture according to the invention.

The partly broken-open perspective view of FIG. 1 shows a piece of furniture 1 having a plurality of drawers 2 which are arranged in a furniture body 4, which can be pulled out, and which are mounted in the furniture body 4 in each case by two pull-out guides 3, 13 arranged on opposite sides of the furniture body 4. The pull-out guides 3, 13 are arranged on opposite side panels 2*c* of the drawer 2, wherein the pull-out guides 13 are not visible due to the angle of view. The drawer 2 has a front panel 2*a* on its front side and a drawer rear panel 2*d* on its rear side. The drawer bottom 2*b* is arranged in between.

Figure 2:
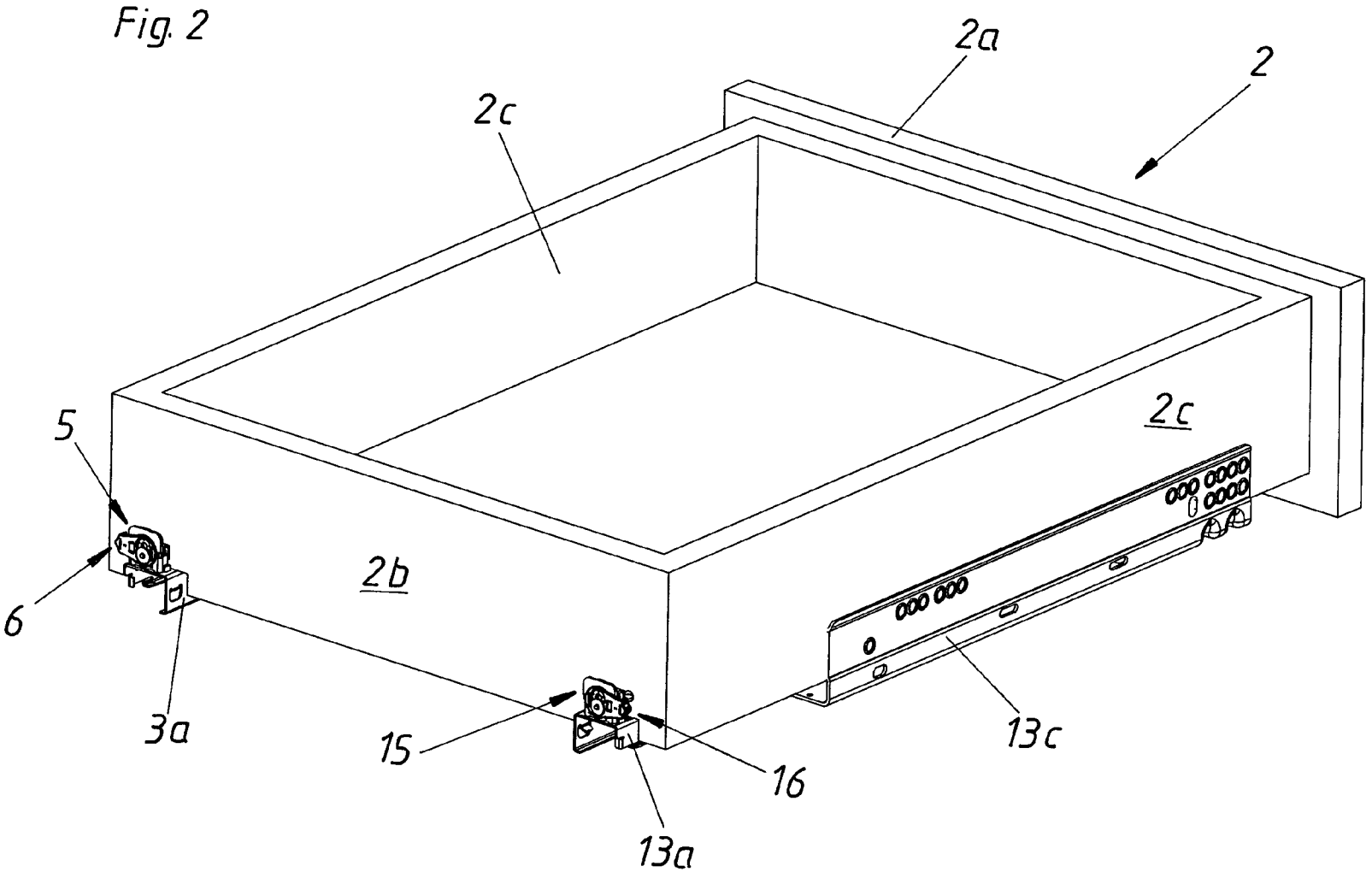
FIG. 2 shows a perspective view of a drawer having a pull-out guide fitting according to the invention.

FIG. 2 shows a perspective view of a drawer 2, in which a first pull-out guide 3 according to the invention is arranged on a first side panel 2*c*. A second pull-out guide 13 is arranged on the opposite second side panel 2*c*. The pull-out guides 3, 13 comprise body rails 3*c*, 13*c* and pull-out rails 3*a*, 13*a* mounted on them such that they can be moved. A first holding element 5 is arranged on the pull-out rail 3*a*. The holding element 5 has a first height adjustment mechanism 6. The second holding element 15 correspondingly has a second height adjustment mechanism 16. The first holding element 5 and the second holding element 15 each have a guide device, by which the first connection element 7 or the second connection element 17 is guided such that it can be slid in the vertical direction (in the assembled state of the pull-out guide 3, 13) in order to move on the first holding element 5 or the second holding element 15. The first connection element 7 is spring-loaded by a spring element 8. A lateral adjustment mechanism for actively setting the lateral position of the second connection element 17 is only arranged on the second holding element 15. With regard to movability in the horizontal direction (in the assembled position of the pull-out guide 3), the connection element 7 of the holding element 5 is mounted floating with the exception of the spring loading by the spring element 8. In the state connected to the drawer 2, the connection element 7 can therefore follow the movement of the second connection element 17 effected by the lateral adjustment mechanism.

Figure 3A:
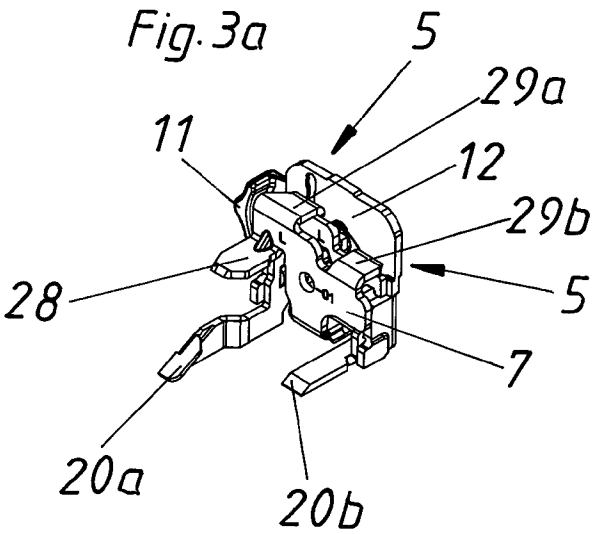
FIGS. 3*a* and 3*b* show a perspective view of a holding element according to the invention and an associated exploded representation.
Figure 3B:
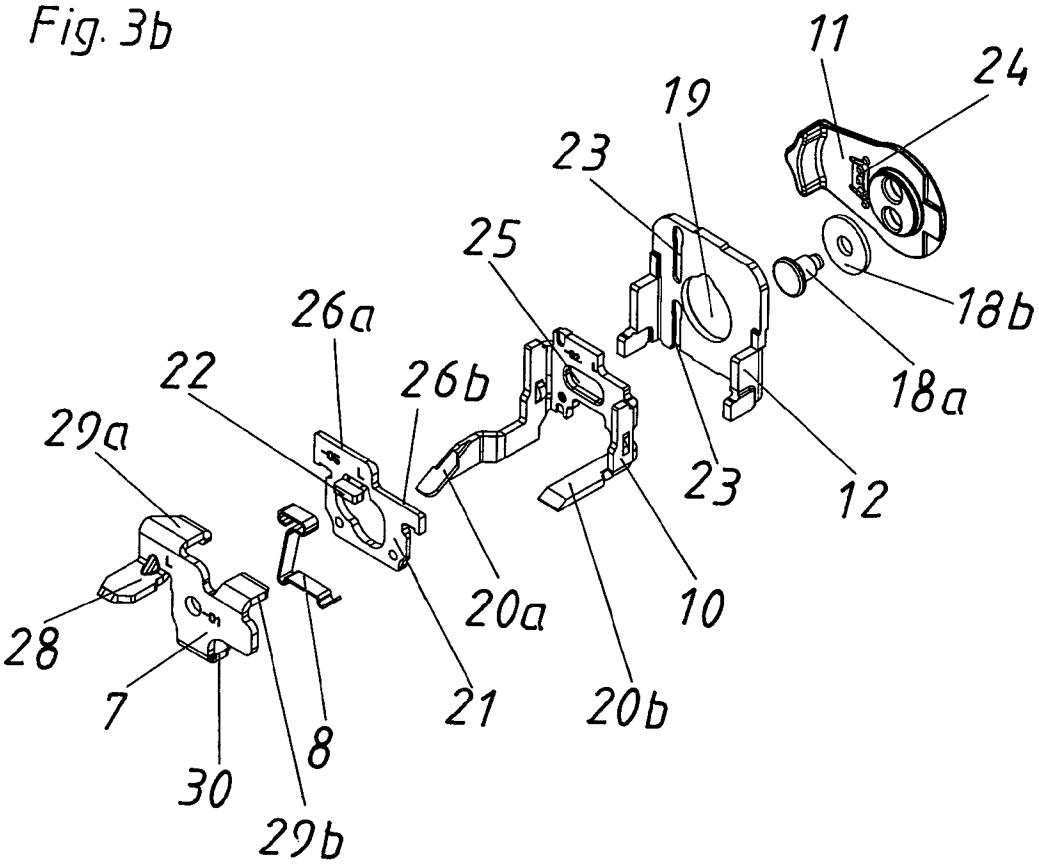

FIG. 3*a* shows the first holding element 5 in a perspective view. An associated exploded representation is shown in FIG. 3*b*. The first height adjustment mechanism 6 comprises a converting mechanism 11 in the form of an adjusting lever which in the assembled position is pivotably mounted about an axis arranged parallel to the longitudinal direction of the pull-out rail 3*a* by the two-part bearing pin 18*a*, 18*b*. The latching elements 24 serve to lock with corresponding recesses 33 (see FIG. 9*b*) which are arranged on the rear side of a mounting plate (attachment member) 12 which is part of the first holding element 5.

Recesses 23 formed as elongated holes serve to guide the connection element 7 during vertical movement (i.e., when setting the vertical position of the connection element 7 by the height adjustment mechanism 6). Corresponding projections 34 (see FIG. 9*b*), which are arranged on the rear side of the base support 10 and which are engaged with the recesses 23 and are mounted such that they can be slid in these recesses 23, serve for this purpose.

The pin 18*a* is connected to the converting mechanism 11 through the opening 25 in the base support 10 and the opening 19 in the mounting plate 12. By a rotation of the adjusting lever, the base support 10 is moved vertically due to the connection via the opening 25, wherein this movement is guided through the side panels of the base plate 12 and the recesses 23. The adjusting lever of the converting mechanism 11 is rotated about an axis parallel to the longitudinal direction of the pull-out rail 3*a*. In doing so, this rotatory movement is transferred or transformed into a translatory movement of the base support 10 and ultimately of the connection element 7 connected to the base support 10.

The mounting plate 12 is attached directly to the pull-out rail 3*a*. The base support 10 has support brackets 20*a*, 20*b*, on which the drawer bottom 2*b* at least partly rests when the drawer 2 is connected to the connection element 7. As a result of the connection to the drawer via the connection element 7, the vertical movement of the base support 10 is transferred to the drawer 2, so that it moves in the vertical direction relative to the pull-out rail 3*a*. The support brackets 20*a*, 20*b* are mounted in corresponding openings in the pull-out rail 3*a*.

An intermediate plate 21 is arranged in the base support 10 in such a way that its vertical movements are transferred to the intermediate plate 21. The spring element 8 is mounted on a projection 22 of the intermediate plate 21. Guide ridges (i.e., guide rails) 26*a*, 26*b* are arranged on the top of the intermediate plate 21 and serve to guide the lateral and the vertical movements of the connection element 7. The connection element 7 has a hook-shaped holding lug 28 which can engage with a corresponding opening of the drawer rear panel 2*d* to connect the connection element 7 to the drawer 2 and to transfer vertical or horizontal movements of the connection element 7 to the drawer 2.

Guide profiles (i.e., guide casings) 29*a*, 29*b* are arranged on the top of the connection element 7 and are engaged with the guide ridges (i.e., guide rails) 26*a*, 26*b*. The holding profiles 29*a*, 29*b* can slide over the guide ridges 26*a*, 26*b* in the lateral direction, so that there is a guided lateral movement. In the case of a vertical movement of the intermediate plate 21, the connection element 7 is also vertically moved with it likewise by the guide profiles 29*a*, 29*b* encompassing the ridges 26*a*, 26*b*.

A holding profile 30, which is engaged with the spring element 8, is arranged on the bottom of the connection element 7. The connection element 7 is spring-loaded by the spring element 8 via this holding profile 30.

Figure 4A:
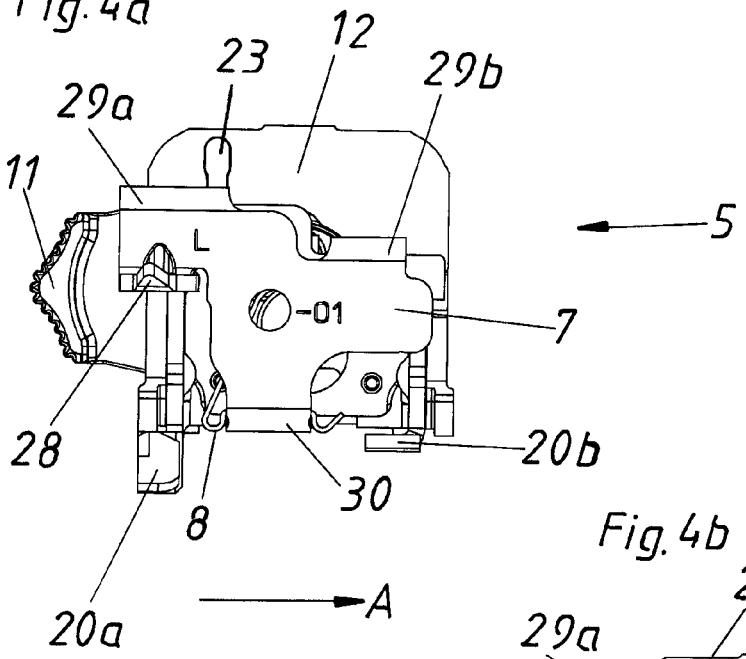
FIGS. 4*a* to 4*c* show frontal views of the holding element according to the invention in different positions.

FIG. 4*a* shows the connection element 7 in a first end position. The spring element 8 is displaced from its neutral position and exerts via the holding profile 30 a restoring force on the connection element 7 in the direction of arrow A. The connection element 7 is in the process displaced in the lateral direction.

Figure 4B:
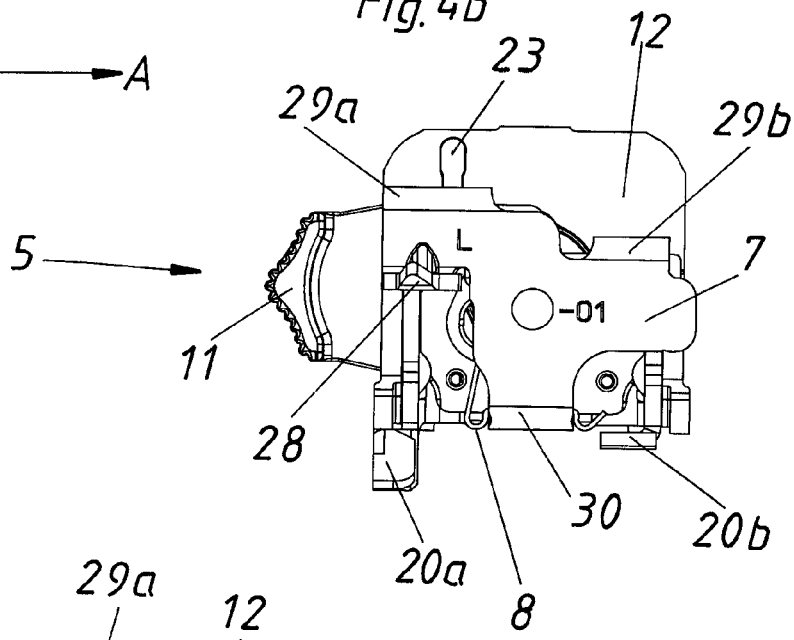

FIG. 4*b* shows the connection element 7 in the neutral position, in which no force is exerted on the connection element 7. Compared with FIG. 4*a*, the connection element 7 has been slid to the right along the ridges 26*a*, 26*b*. The ridges 26*a*, 26*b* serve as a guide for the guide profiles 29*a*, 29*b*.

Figure 4C:
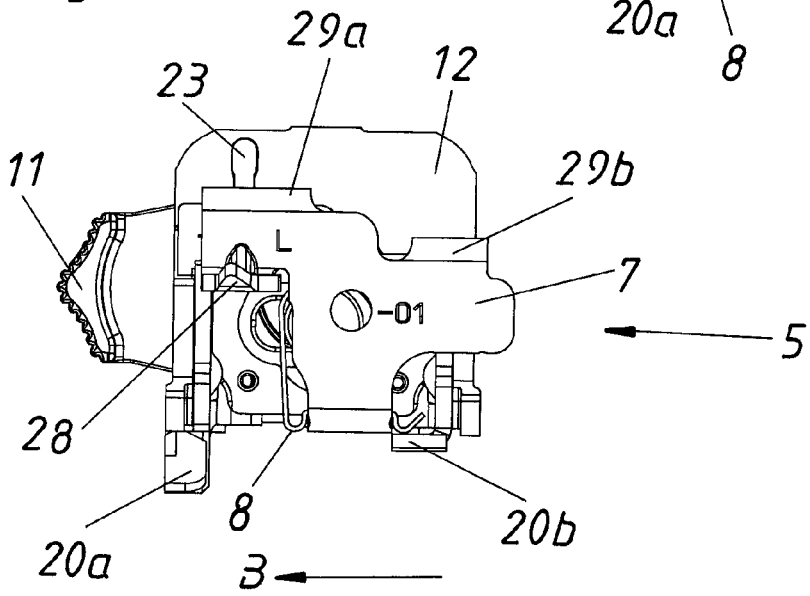

FIG. 4*c* shows the connection element 7 in a second end position. The spring element 8 has been displaced from its neutral position in the lateral direction, whereby a force is exerted on the connection element 7 in the direction of arrow B. Therefore, the connection element 7 is slid back to the neutral position, provided that the drawer 2 is not connected to the connection element 7, since the spring element 8 would not in this case be formed strongly enough for a reset to take place.

In FIGS. 4*a* to 4*c*, the connection element 7 is only displaced in the lateral direction between the first end position and the second end position. A drawer 2 connected to the connection element 7 would, in the case of such a displacement, be moved in the lateral direction relative to the pull-out rail 3*a*. As is apparent by reference to the position of the connection element 7 relative to the recesses 23 and from the position of the converting mechanism 11, in FIGS. 4*a* to 4*c* the connection element 7 is not moved in the vertical direction (i.e., with respect to the height).

Figure 5A:
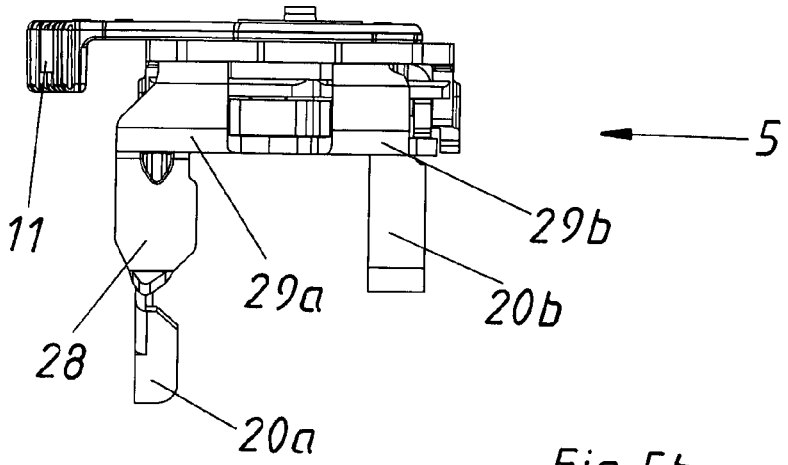
FIGS. 5*a* to 5*c* show plan views relating to FIGS. 4*a* to 4*c*.
Figure 5B:
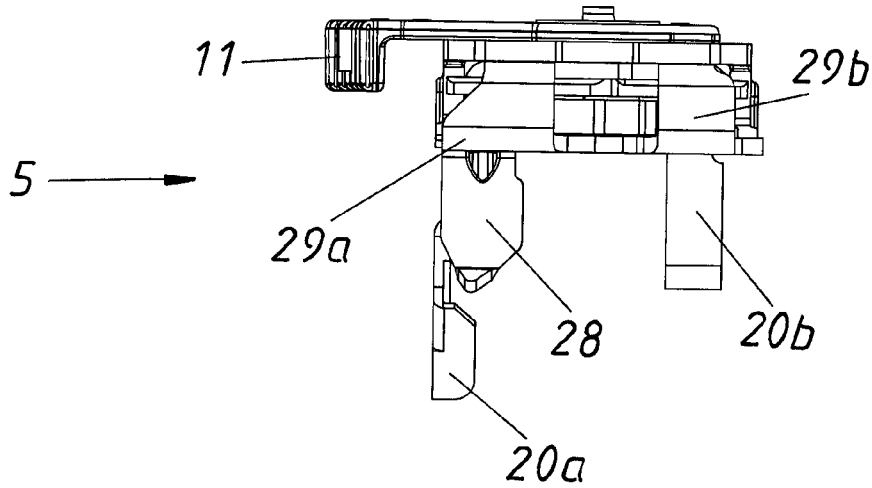
Figure 5C:
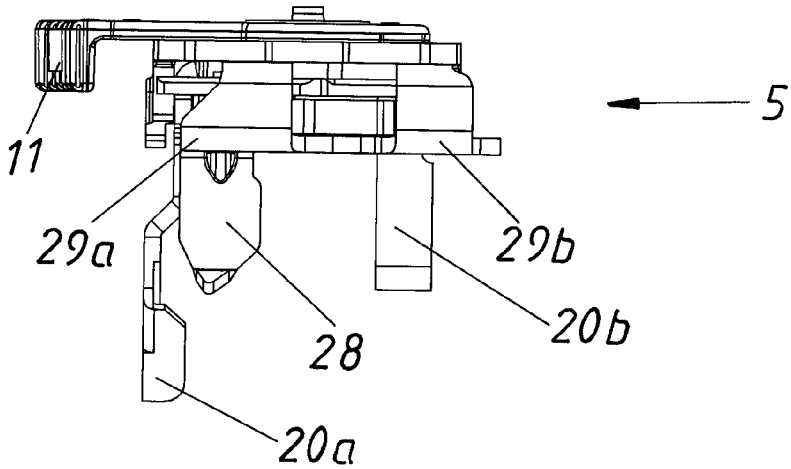

In FIGS. 5*a* to 5*c*, in each case a plan view of the holding element 5 with the connection element 7 corresponding to FIGS. 4*a* to 4*c* is shown. It can be identified that the holding lug 28 of the connection element 7 is mounted such that it can be moved between the first end position (FIG. 5*a*) and the second end position (FIG. 5*c*). FIG. 5*b* corresponds to the neutral position between the first end position and the second end position.

Figure 6:
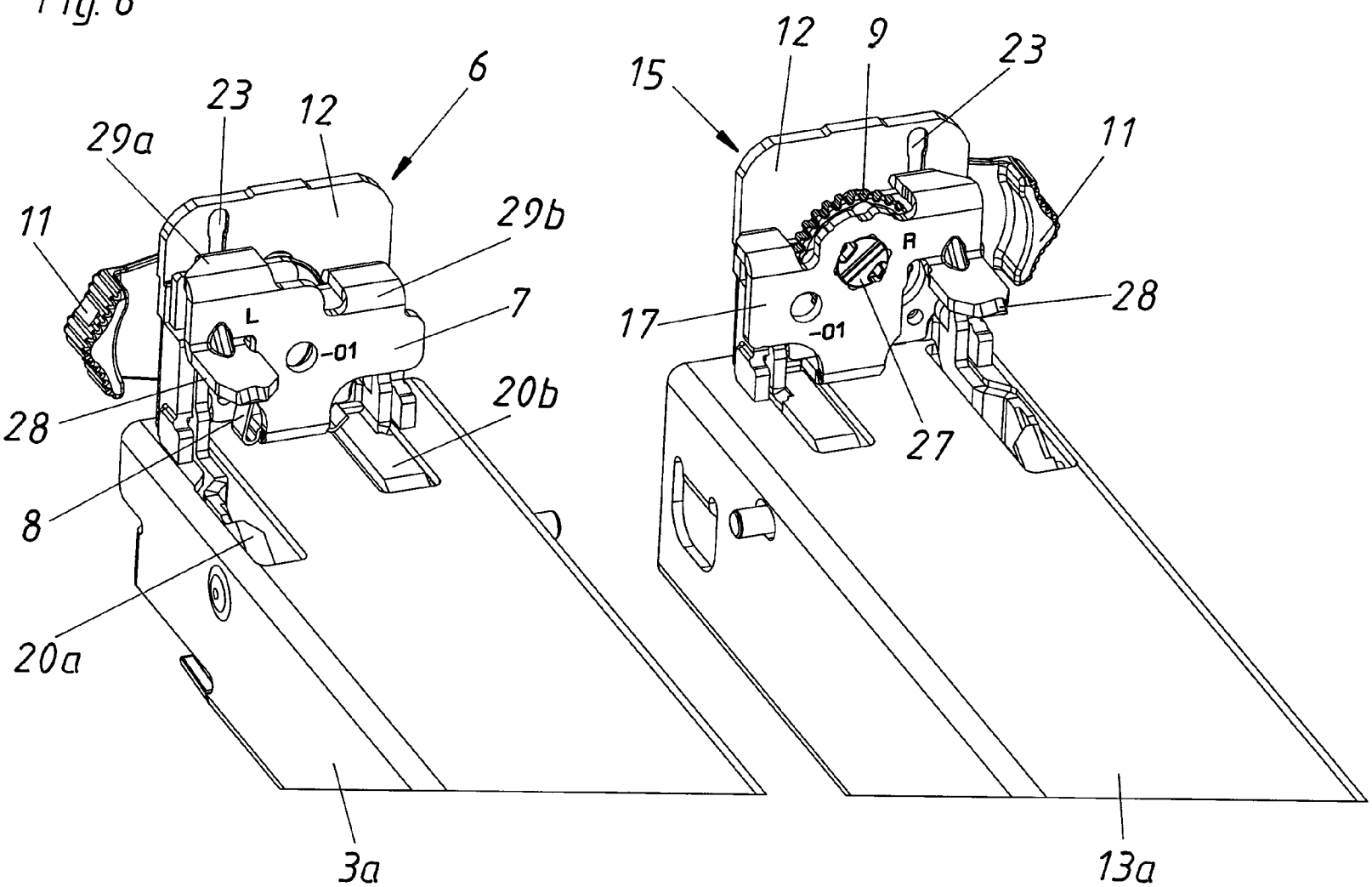
FIG. 6 shows a perspective view of a part of a pull-out guide fitting according to the invention with a holding element and a second holding element.

FIG. 6 shows parts of a pull-out guide fitting, comprising two pull-out rails 3*a*, 13*a* which are mounted such that they can be moved on body rails 3*c*, 13*c* which are not illustrated in this figure. The first holding element 6 arranged on the pull-out rail 3*a* corresponds to the holding element shown in the previous figures. A second holding element 15, in which a second connection element 17 is mounted such that it can be moved, is arranged on the pull-out rail 13*a*. A second height adjustment mechanism 16 essentially corresponds to the first height adjustment mechanism 6 in terms of its function and design. In particular, the second height adjustment mechanism 16 also has a converting mechanism 11 having an adjusting lever. However, in contrast to the first connection element 7, the second connection element 17 is not acted upon by a spring element 8. Instead, the second holding element 15 has a lateral adjustment mechanism, by which the lateral position of the second connection element 17 can be actively set. Such a lateral adjustment mechanism is shown in the Austrian patent application A 148/2010.

If the connection element 7 and the second connection element 17 are connected to a drawer via the holding lugs 28, when the lateral adjustment mechanism is actuated, the movement of the second connection element 17 is transferred to the first connection element 7. The spring element 8 only causes the connection element 7 to be reset into the neutral position when the drawer 2 is not connected. The lateral adjustment mechanism has a converting mechanism 9 which can be operated by hand. However, this can also be actuated by a screwdriver via the actuating element 27. The lateral position of the drawer 2 relative to the pull-out rail 13*a* can thus be set via the second holding element 15. The connection element 7 can follow this movement when it is connected to the drawer 2. When it is not connected to the drawer 2, the connection element 7 is held in the neutral position by the spring element 8. The holding lug 28 of the connection element 7 can thereby be easily inserted into openings provided in the drawer 2 for this purpose, whereby the drawer 2 can be simply assembled.

Figure 7A:
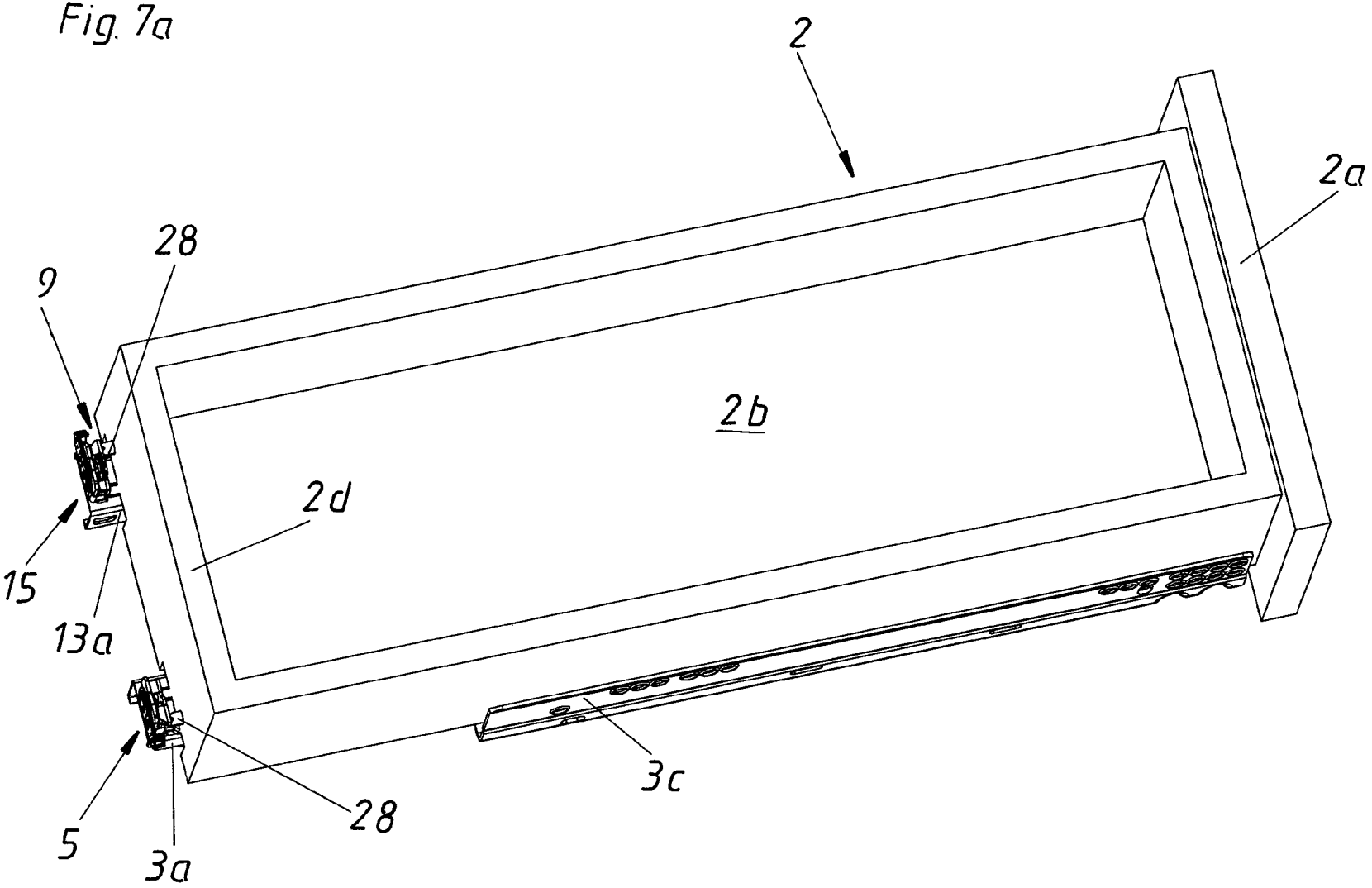
FIGS. 7*a* and 7*b* show a drawer having a pull-out guide fitting according to the invention in two different lateral positions.

FIG. 7*a* shows a perspective view of a drawer 2 having a pull-out guide fitting according to the invention. The holding element 5, which is arranged on the pull-out rail 3*a*, is in its neutral position. The drawer 2 can be moved laterally relative to the pull-out rails 3*a*, 13*a* by actuating the lateral adjustment mechanism on the second holding element 15. The holding lugs 28 of the holding elements 5, 15 are arranged in corresponding openings in the drawer rear panel 2*d*.

Figure 7B:
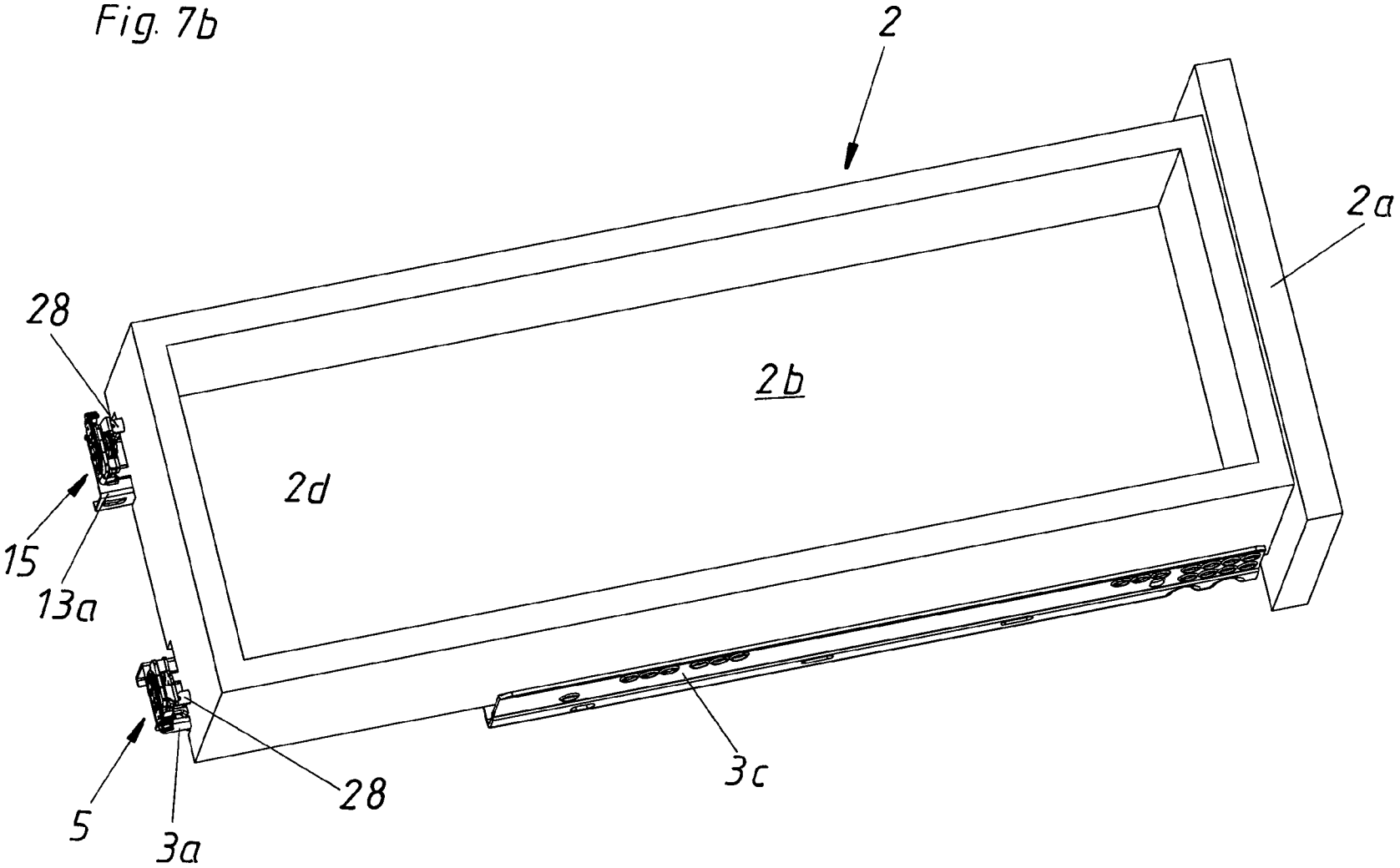

In contrast, in FIG. 7*b* the connection element 7 of the holding element 5 is moved in the direction of the second end position. The spring element 8 is, however, not strong enough to slide the connection element 7 together with the drawer 2 connected via the holding lug 28 back into the neutral position, as would be the case without a drawer 2 connected.

Figure 8A:
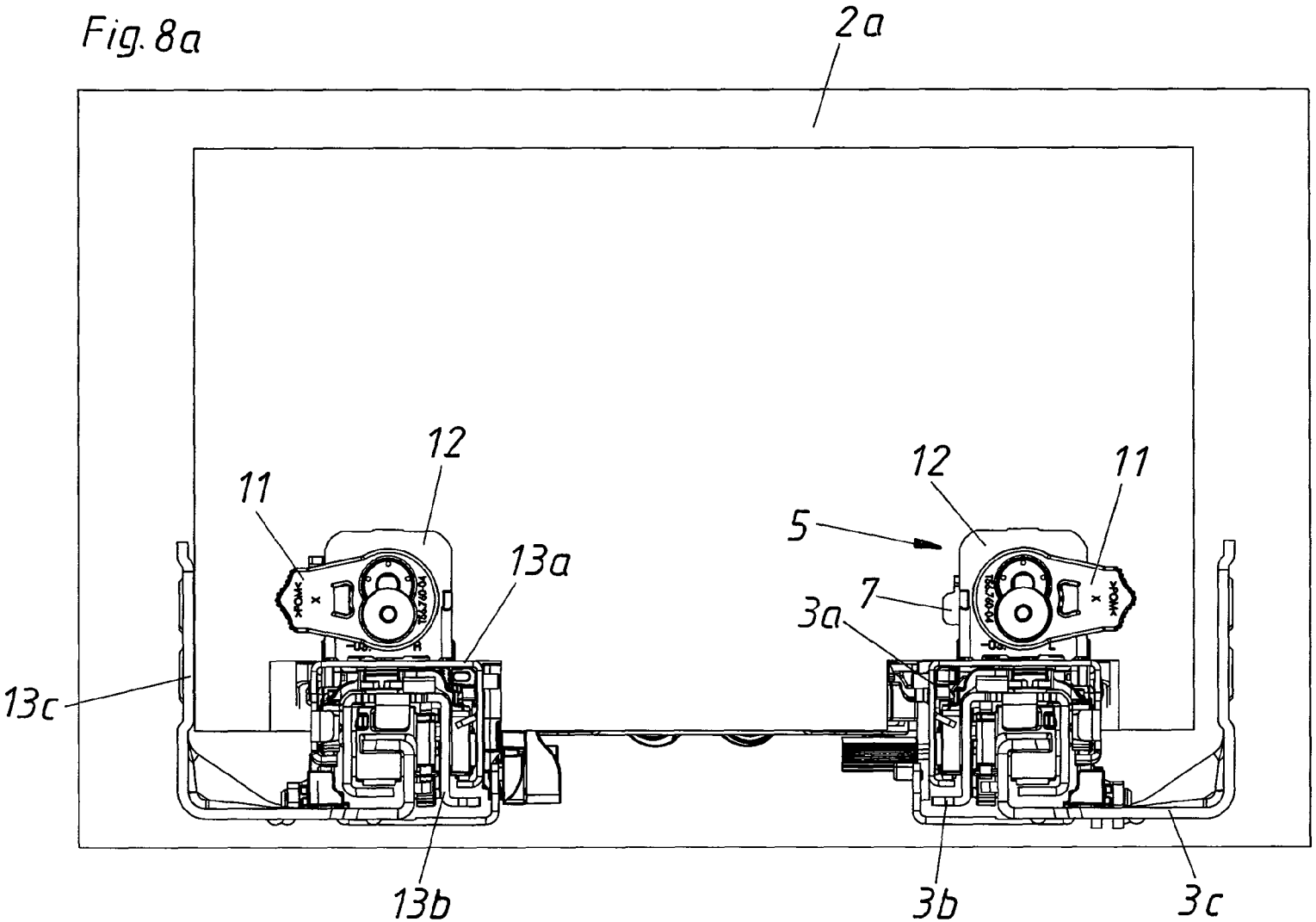
FIGS. 8*a* and 8*b* show views from the rear relating to FIGS. 7*a* and 7*b*, and FIGS. 9*a* and 9*b* show a perspective view of a spring-loaded connection element and a further exploded representation of the associated holding element.
Figure 8B:
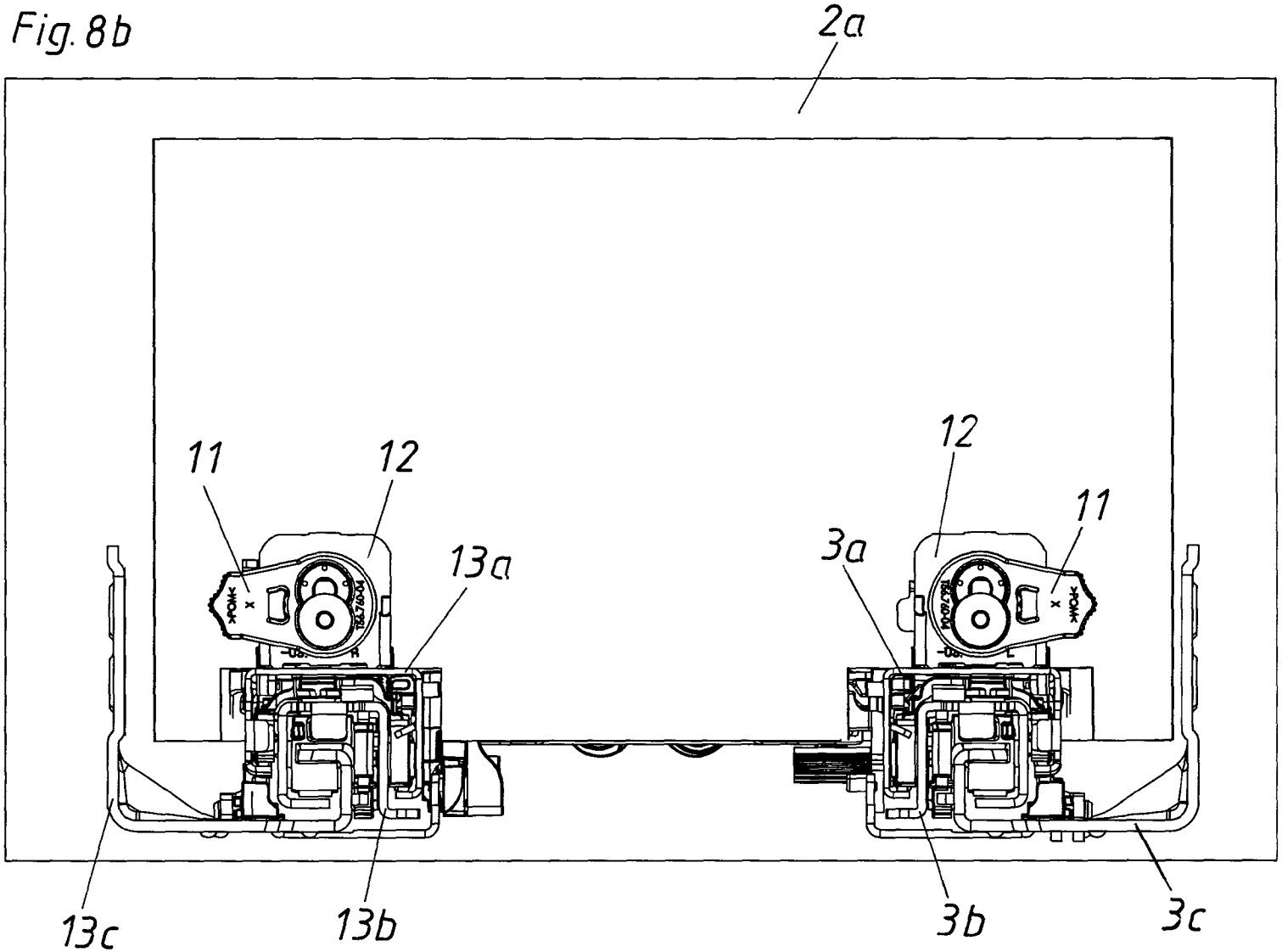

FIGS. 8*a* and 8*b* show a partly broken-open rear view of the drawer 2 with the pull-out guide fitting according to the invention corresponding to FIGS. 7*a* and 7*b*. In FIG. 8*a*, the connection element 7 is in the neutral position, while in FIG. 8*b* a movement in the direction of the second end position is effected. Middle rails 3*b*,13*b*, which are mounted such that they can be moved, can be identified arranged between the pull-out rails 3*a*, 13*a* and the body rails 3*c*, 13*c*.

Figure 9B:
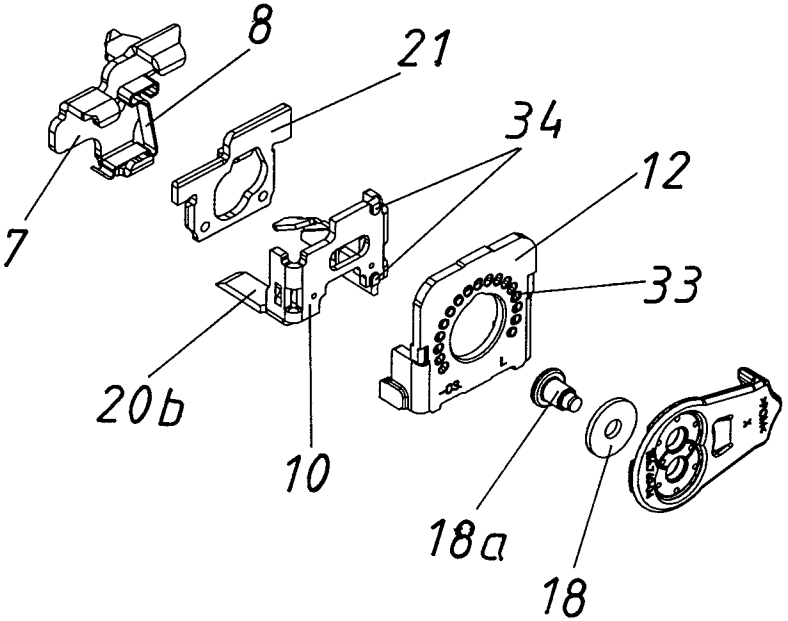
Figure 9A:
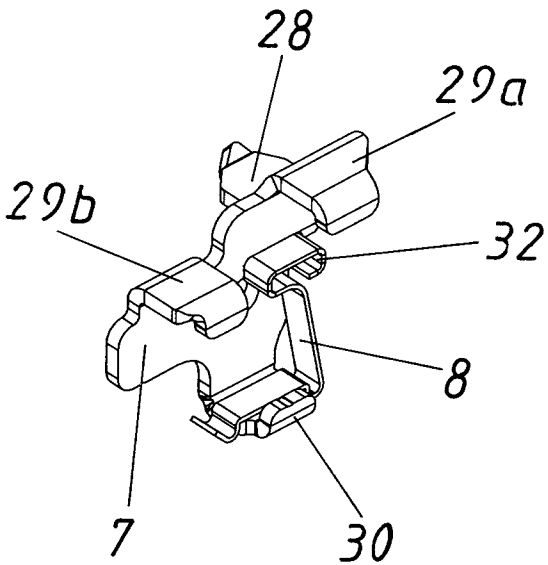

FIG. 9*a* shows a perspective view of the connection element 7 together with the spring element 8 mounted on the holding profile 30. The bearing 32 is mounted on the projection 22 of the intermediate plate 21. When the connection element 7 is laterally displaced it is acted upon by the spring element 8, so that a restoring force in the direction of the neutral position is present.

FIG. 9*b* shows a further exploded representation of the essential elements of the holding element 5 in a different view from FIG. 3*b*. Recesses 33, arranged circularly on the mounting plate 12 and formed corresponding to the latching elements 24 of the converting mechanism 11, can be identified. A step by step rotation of the converting mechanism 11 (and hence a step by step vertical movement of the connection element 7) is made possible by the latching elements 24 which engage with the recesses 33 in a locking manner.

Projections 34, which are mounted in the recesses 23 in the mounting plate 12 such that they can be slid, are arranged on the intermediate plate 12. They serve to guide the base support 10 and hence the connection element 7 when the height adjustment takes place (i.e., when the translatory movement effected by the converting mechanism 11 takes place).

The invention claimed is:

1. A pull-out guide for a drawer, said pull-out guide comprising:

a body rail to be attached to a furniture body;

a pull-out rail movable relative to said body rail; and a holding element including:

an attachment member connecting said holding element to said pull-out rail;

a connection element for connecting said pull-out rail to the drawer, said connection element being mounted to said attachment member so as to be movable relative to said attachment member between a first end position and a second end position; and a spring element for holding said connection element in a neutral position, said spring element being located between the first end position and the second end position.

2. The pull-out guide according to claim 1, wherein said connection element is mounted so as to be movable horizontally relative to said attachment member.

3. The pull-out guide according to claim 2, wherein said connection element is mounted so as to be movable in a lateral direction transverse to a longitudinal axis of said pull-out rail.

4. The pull-out guide according to claim 1, wherein said connection element is configured to be connected to a rear panel of the drawer.

5. The pull-out guide according to claim 1, further comprising a middle rail between said pull-out rail and said body rail.

6. The pull-out guide according to claim 1, wherein said holding element further includes a guide device for guiding said connection element so that said connection element slides on said holding element.

7. The pull-out guide according to claim 6, wherein said guide device includes a guide rail and a guide casing at least partly encompassing said guide rail and mounted so as to slide along said guide rail, said guide casing being arranged on said connection element.

8. The pull-out guide according to claim 6, wherein said guide device includes an elongated hole, and a guide pin of said connection element is mounted in said elongated hole so as to move through said elongated hole.

9. The pull-out guide according to claim 1, wherein said connection element includes a hook-shaped holding lug for engaging a recess in the drawer.

10. The pull-out guide according to claim 9, wherein said holding lug is elastically spring-loaded.

11. The pull-out guide according to claim 10, wherein said holding element further includes a height-adjustment mechanism for vertically moving said connection element relative to said attachment member, said height-adjustment mechanism including a rotatable converting mechanism rotationally movable about an axis substantially parallel to a longitudinal axis of said pull-out rail, said height-adjustment mechanism being configured to convert a rotatory movement of said converting mechanism into a translatory movement of said connection element.

12. The pull-out guide according to claim 11, wherein said converting mechanism is configured to be actuated by a screw and/or a handle.

13. The pull-out guide according to claim 12, wherein said converting mechanism is configured to be actuated by at least a handle formed as a lever.

14. The pull-out guide according to claim 1, wherein said holding element further includes a height-adjustment mechanism for vertically moving said connection element relative to said attachment member.

15. The pull-out guide according to claim 1, wherein said holding element further includes a lateral adjustment mechanism for moving said connection element between the first end position and the second end position.

16. The pull-out guide according to claim 15, wherein said lateral adjustment mechanism includes a rotationally movable converting mechanism rotationally movable about an axis substantially parallel to a longitudinal axis of said pull-out rail, said lateral adjustment mechanism being configured to convert a rotatory movement of said converting mechanism into a translatory movement of said connection element.

17. The pull-out guide according to claim 1, wherein said holding element further includes a locking device for releasable locking a height adjustment mechanism for vertically moving said connection element relative to said attachment member and/or a lateral adjustment mechanism for moving said connection element between the first end position and the second end position.

18. A pull-out guide fitting for a drawer, comprising:

a first pull-out guide comprising said pull-out guide according to claim 1 to be arranged on a first side of the drawer; and a second pull-out guide to be arranged on a second side of the drawer opposite the first side, said second pull-out guide including a second pull-out rail and a second holding element including:

a second attachment member connecting said second holding element to said second pull-out rail;

a second connection element connecting the drawer to said second pull-out rail; and a lateral adjustment mechanism for moving said second connection element relative to the second attachment member in a direction parallel to a movement direction of said connection element of said first pull-out guide between the first end position and the second end position.

19. The pull-out guide fitting according to claim 18, wherein said lateral adjustment mechanism includes a rotatable converting mechanism rotationally movable about an axis substantially parallel to a longitudinal axis of said second pull-out rail, said lateral adjustment mechanism being configured to convert a rotational movement of said converting mechanism into a translatory movement of said second connection element.

20. The pull-out guide fitting according to claim 18, wherein said second holding element further includes a second guide device for guiding said second connection element so that said second connection element slides along said second holding element.

21. The pull-out guide fitting according to claim 18, wherein said second holding element further includes a second locking device for releasably locking said second connection element.

22. The pull-out guide fitting according to claim 18, wherein said second holding element further includes a second height adjustment mechanism for vertically moving said second connection element relative to said second attachment member.

23. An item of furniture comprising:

a furniture body;

a drawer movable relative to said furniture body; and a pull-out guide for supporting said drawer, said pull-out guide comprising:

a body rail attached to said furniture body;

a pull-out rail movable relative to said body rail; and a holding element including:

an attachment member connecting said holding element to said pull-out rail;

a connection element for connecting said pull-out rail to said drawer, said connection element being mounted to said attachment member so as to be movable relative to said attachment member between a first end position and a second end position; and a spring element for holding said connection element in a neutral position, said spring element being located between the first end position and the second end position.

* * * * *